US010451370B2

(12) United States Patent
Cheng et al.

(10) Patent No.: US 10,451,370 B2
(45) Date of Patent: Oct. 22, 2019

(54) MAGAZINE OPENER

(71) Applicants: Carson Cheng, City of Industry, CA (US); Changan Tian, City of Industry, CA (US); Richard Thomas, City of Industry, CA (US)

(72) Inventors: Carson Cheng, City of Industry, CA (US); Changan Tian, City of Industry, CA (US); Richard Thomas, City of Industry, CA (US)

(73) Assignee: NcSTAR, Inc., City of Industry, CA (US)

( * ) Notice: Subject to any disclaimer, the term of this patent is extended or adjusted under 35 U.S.C. 154(b) by 139 days.

(21) Appl. No.: 15/592,155

(22) Filed: May 10, 2017

(65) Prior Publication Data

US 2018/0328685 A1 Nov. 15, 2018

(51) Int. Cl.

| | |
|---|---|
| ***B25B 13/28*** | (2006.01) |
| ***F41A 11/00*** | (2006.01) |
| ***B66F 15/00*** | (2006.01) |
| ***F41A 35/00*** | (2006.01) |
| *F41A 9/65* | (2006.01) |

(52) U.S. Cl.

CPC ..... *F41A 11/00* (2013.01); *B25B 13/28* (2013.01); *B66F 15/00* (2013.01); *F41A 35/00* (2013.01); *F41A 9/65* (2013.01); *Y10T 29/5373* (2015.01)

(58) Field of Classification Search

CPC ..... Y10T 29/4978; Y10T 29/49881; F41A 11/00; F41A 35/00; F41A 9/65; B66F 15/00; B25B 13/28; B25B 13/02

See application file for complete search history.

(56) References Cited

U.S. PATENT DOCUMENTS

| | | | | | |
|---|---|---|---|---|---|
| 464,084 | A * | 12/1891 | Robinson | B25B 13/48 | 81/176.1 |
| 2,440,485 | A * | 4/1948 | Ranseen | B67B 7/162 | 29/229 |
| 2,694,326 | A * | 11/1954 | Lewis | B67B 3/02 | 29/243.57 |
| 2,814,225 | A * | 11/1957 | Mann | B25B 13/46 | 81/90.3 |
| 5,127,121 | A * | 7/1992 | Bossie | B25D 1/02 | 30/358 |
| 5,247,715 | A * | 9/1993 | Nishiguchi | B25B 13/00 | 7/138 |
| 2015/0128769 | A1* | 5/2015 | Albrecht | B25B 13/50 | 81/99 |

* cited by examiner

*Primary Examiner* — Sarang Afzali
*Assistant Examiner* — Ruth G Hidalgo-Hernandez
(74) *Attorney, Agent, or Firm* — Raymond Y. Chan; David and Raymond Patent Firm

(57) ABSTRACT

A magazine opener for removing a floor plate of a firearm magazine, wherein the floor plate defines a hole and the magazine defines a side wall, wherein the opener includes: a handle having a first end and a second free end; a first arm pivotally connected with the first end of the handle; a second arm extended from the handle to form an engagement point biased against the side wall; wherein the first arm comprises a L-shaped element inserted into the hole to secure the first arm with the floor plate.

15 Claims, 6 Drawing Sheets

MAGAZINE OPENER

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an opener, and more particularly to a universal magazine opener for removing a floorplate of a variety models of firearm magazine.

Description of Related Arts

Conventional firearm, such as a gun or rifle, usually utilizes magazines for holding cartridges to assist in feeding the ammunition into the firearm. However, the detachable magazines are widely used in the automatic weapons, such as Pistols, throughout the market. The magazines are shaped in variety geometric variations, such as straight and curved box magazines, wherein the magazines usually comprises a magazine body, a floor plate associated with the magazine body, and a spring-loaded follower having a spring affixed thereon, and a lock plate disposed inside the magazine body to securely latch the floor plate on the magazine body. In other words, the lock plate and the floor plate are interfaced together with a tab on the locking plate resting within a slot of the floor plate, so, with the floor plate affixing the magazine body and the lock plate holding the floor plate laterally, the lock plate is forced against by the spring to prevent the floor plate sliding off the magazine body.

In order to remove the floor plate from the magazine body, some disassembly tools are provided in the current market. The most commonly tool to dissemble the magazine is a punch. In such manner, the tab on the lock plate is pushed by the tapered end of the punch, and one hand of the operator is required to hold on the magazine body, and the other hand of the operator is holding the punch with the tapered end of the punch being inserted into the slot of the floor plate, and then the operator is required to muscle up for forcedly pulling the floor plate away from the magazine body, so the operator can inadvertently damage the magazine when removing or attempting to remove the floor plate. In other words, sometimes, the floor plate get stuck on the magazine body, so while the operator forcedly pulls the floor plate away from the magazine body, he/she may get hurt or collides on other proximate objects.

An improved disassembly tool comprising a handle end and an opposite gripping member having a first gripping arm and a second arm is provided to dissemble the firearm magazine. The first gripping arm is laterally extended from the handle to bias against the magazine body, and the second arm extended from the handle comprises a pin for inserting into the slot of the floor plate, wherein the operator is required to exert a downward force to the handle to remove the floor plate. However, this improved disassembly tool is not a universal magazine opener. Since this disassembly tool is integrally formed, lengths of the first gripping arms and the second arm are affixed, so if an extended floor plate is used on the magazine, the extended floor plate cannot be efficiently remove from the magazine body by the above mentioned disassembly tool. Therefore, the operator requires exchanging to the traditional punch in order to remove the floor plate.

SUMMARY OF THE PRESENT INVENTION

The invention is advantageous in that it provides a magazine opener, wherein the magazine opener is able to remove a floor plate of a firearm magazine through leverage.

Another advantage of the invention is to provide a magazine opener which comprises a first arm coupled on the floor plate, a second arm biased against a side wall of the magazine body to define a fulcrum, and a second end of a handle for enduring the press force applied thereon directly. In other words, a pulling force is naturally generated to the first arm for pulling the floor plate from the magazine body.

Another advantage of the invention is to provide a magazine opener which comprises a L-shaped element formed on the first arm to secure against the detachment between the floor plate and the first arm, so as to prevent the first arm detaching from the floor plate.

Another advantage of the invention is to provide a magazine opener, wherein the first arm is pivotally connected with a first end of the handle for providing an adjustable distance between the L-shaped element and an engagement point of the second arm, so as to allow the magazine opener to be applied to different thicknesses of floor plate.

Another advantage of the invention is to provide a magazine opener, wherein strength of the press force is dramatically smaller than that of the pulling force. In other words, the operators can easily and conveniently open the magazine body without applying a large strength of force to the floor plate, so as to prevent the magazine body to be damaged.

Another advantage of the invention is to provide a magazine opener, wherein no expensive or complicated structure is required to employ in the present invention in order to achieve the above mentioned objects. Therefore, the present invention successfully provides an economic and efficient solution for providing an easy, convenient, effortless, and one-hand operation magazine opener for removing the floor plate from the magazine body.

Another advantage of the invention is to provide a magazine opener, wherein a handle of the magazine opener further comprises a first arm receiving cavity for receiving the first arm in order to create a compact size for the magazine opener while the magazine opener is not in use.

Additional advantages and features of the invention will become apparent from the description which follows, and may be realized by means of the instrumentalities and combinations particular point out in the appended claims.

According to the present invention, the foregoing and other objects and advantages are attained by a magazine opener for removing a floor plate of a firearm magazine, wherein said floor plate defines a hole and the magazine defines a side wall, wherein the opener comprises:

a handle having a first end and a second free end;

a first arm pivotally connected with the first end of the handle;

a second arm extended from the handle to form an engagement point biased against the side wall; wherein the first arm comprises a L-shaped element inserted into the hole to secure the first arm with the floor plate.

In accordance with another aspect of the invention, the present invention comprises a method of removing the floor plate from the magazine body, wherein the method comprises the following step:

(1) Insert a L-shaped element into the hole of the floor plate.

(2) Bias the engagement point of the second arm against the side wall of the magazine body.

(3) Exert the press force on the handle to remove the floor plate from the magazine body through the leverage.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
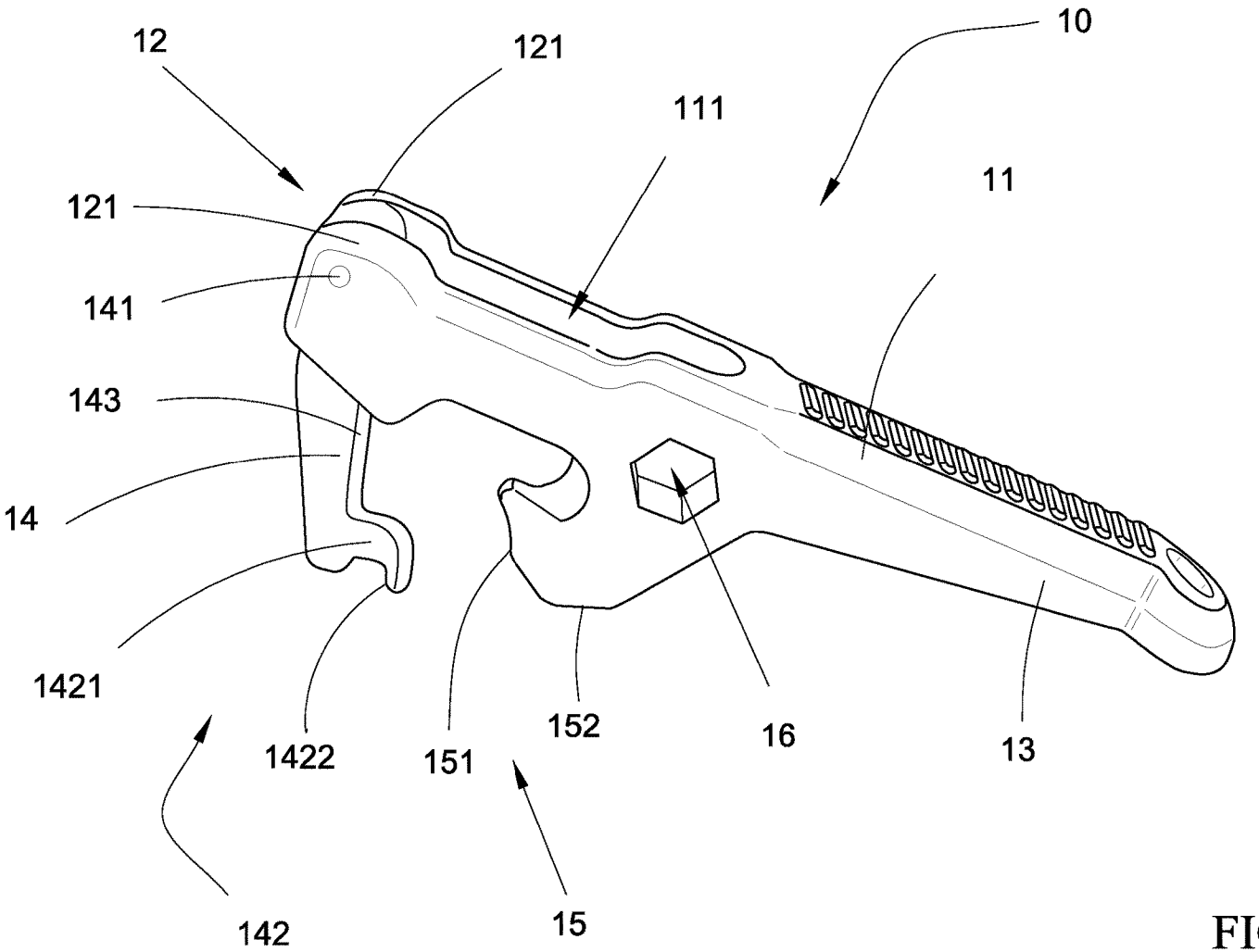
FIG. 1 is a perspective view of a magazine opener according to a preferred embodiment of the present invention.
Figure 2:
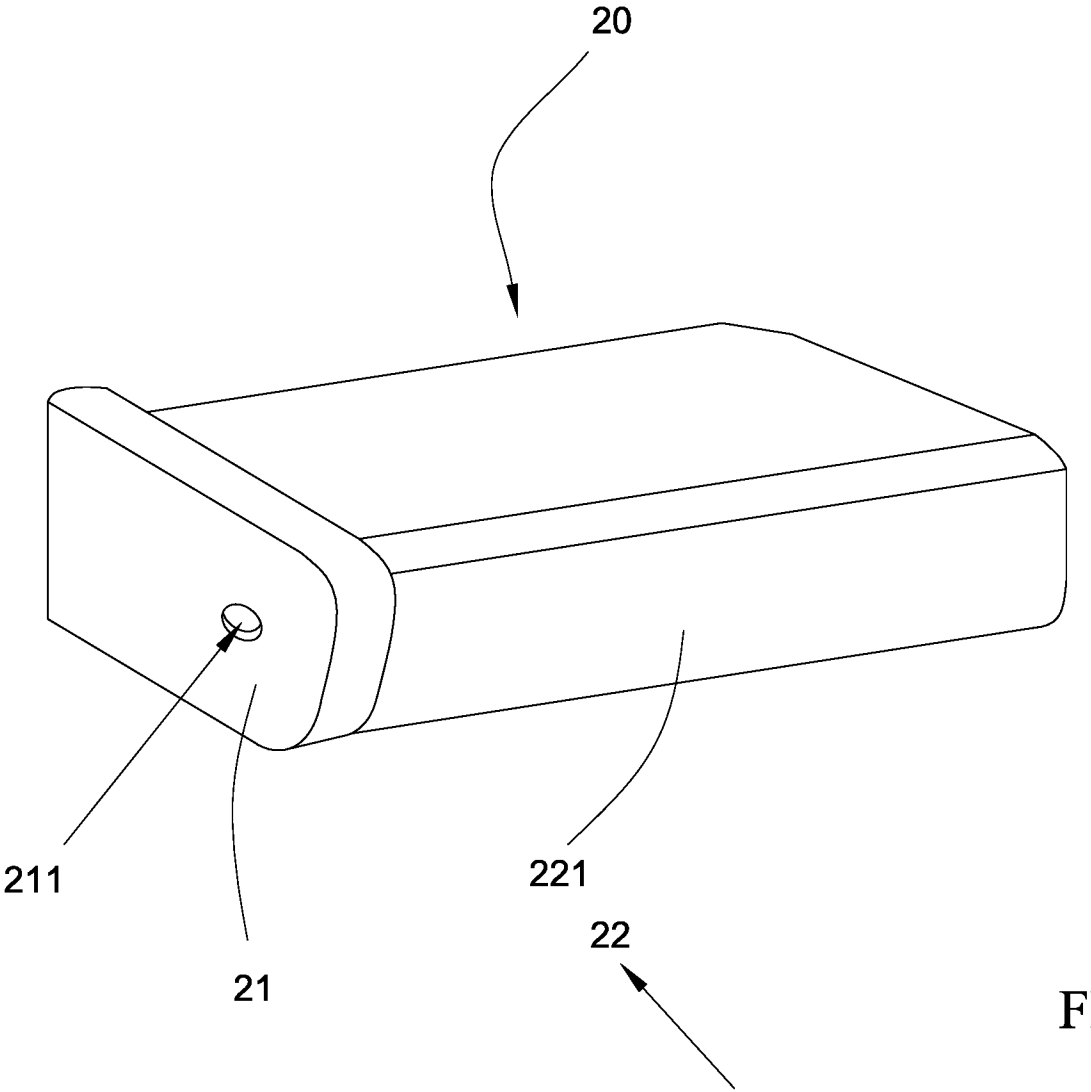
FIG. 2 is a perspective view of a firearm magazine according to a preferred embodiment of the present invention.

Referring to FIG. 1 and FIG. 2 of the drawings, a magazine opener 10 according to a preferred embodiment of the present invention is illustrated, wherein the magazine opener 10 is applied for removing a floor plate 21 of a firearm magazine 20. The floor plate 20 comprises a hole 211, and the magazine 20 further comprises a magazine body 22 having a side wall 221 adjacent to the floor plate 21.

The magazine opener 10 comprises a handle 11 having two spacedly tabs 121 formed on a first end 12 of the handle 11, and a second free end 13, a first arm 14 pivotally connected within the two tabs 121 of the first end 12 of the handle 11, a second arm 15 integrally extended from a predetermined position where a polygonal hole 16 formed on the handle 11, and a first arm receiving cavity 111 formed on a top portion of the handle 11 for storing the first arm 14 while the first arm 14 is not in use.

Figure 3:
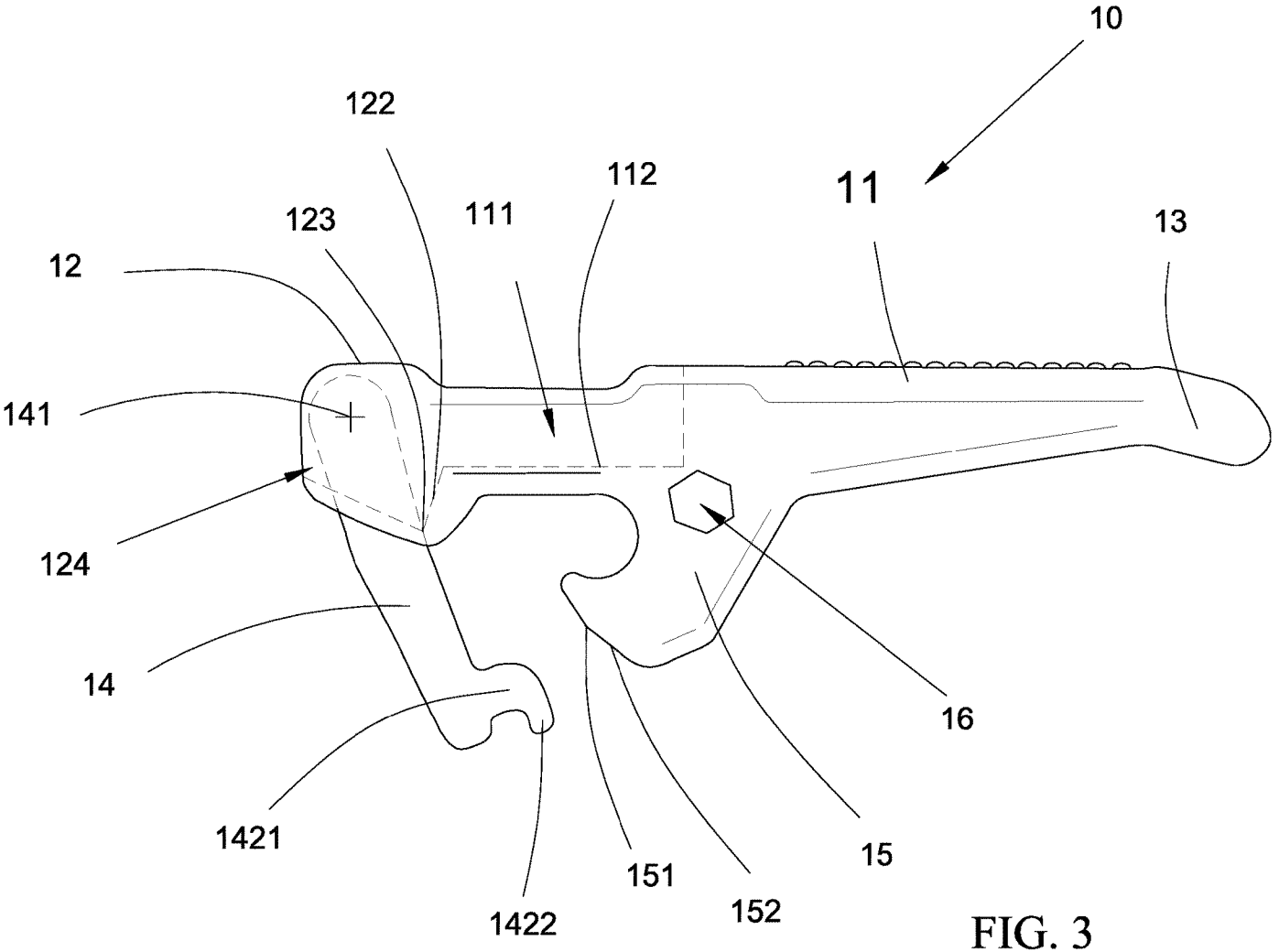
FIG. 3 is a side view of the magazine opener according to the above mentioned preferred embodiment of the present invention, illustrating that a first arm is in an extended position.
Figure 4:
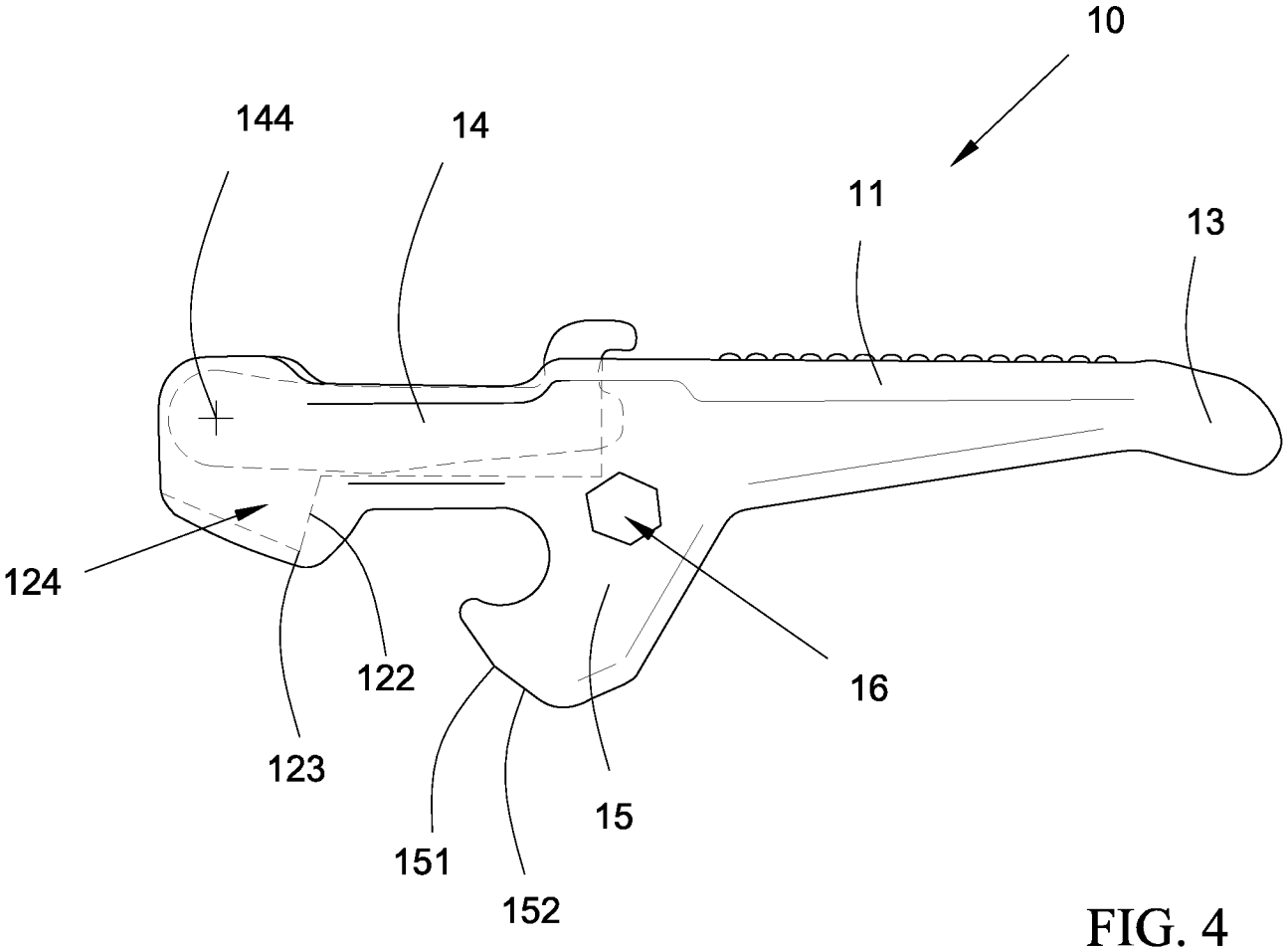
FIG. 4 is a side view of the magazine opener according to the above mentioned preferred embodiment of the present invention, illustrating that a first arm is in a stored position.

Referring to FIG. 3 and FIG. 4 of the drawings, the first end 12 of the handle 11 comprises a blocking wall 122 downwardly and integrally extended from a bottom wall 112 of the first arm receiving cavity 11 to form a blocking end 123 and a blocking cavity 124 defined between the blocking wall 122 and two tabs 121. The first arm 14 comprises a pivot end 141 pivotally connected with the two tabs 121 of the first end 12 of the handle 11 and a terminus having a L-shaped element 142, and a bottom surface 143, wherein the first arm 14 is pivotally operated through the pivot end 141 to conceal the first arm 14 into the first arm receiving cavity 111 in a stored position, as shown in FIG. 4, and selectively, the first arm 14 can be withdrawn from concealment within the first arm receiving cavity 111 in an extended position, as shown in FIG. 3. In other words, the blocking end 123 of the blocking wall 122 is biased against with the bottom surface 143 of the first arm 14 while the first arm 14 is in the extended position, so the first arm 14 is suspended on the blocking wall.

The L-shaped element 142 comprises a vertical member 1421 downwardly extended from the bottom wall 143 of the first arm 14 and a transversal pin 1422 integrally extended from the vertical member 1421 towards a direction opposite to the first arm 14, wherein the transversal pin 1422 is adapted to be inserted into the hole 211 of the floor plate 21. The second arm 15 comprises an engagement point 151 and an engagement surface 152 which can engage with the side wall 221 of the magazine 20.

In addition, the first arm 14 and the second arm 15 have different lengths, wherein the first arm 14 is longer than the second arm 15, so while the bottom surface 143 of the first arm 14 touches with the blocking end 123, the terminus of the first arm 14 is positioned below the second arm 15. A distance (d) is defined between the terminus of the first arm 14 and the engagement point 151 of the second arm 15, wherein the distance (d) is adjustable since the first arm 14 is pivotally connected with the first end 12 of the handle 11 through the pivot end 141. Therefore, the adjustable distance (d) between the first arm 14 and the engagement point 151 of the second arm 15 is able to receive or grip the firearm magazines 20 having different shapes and sizes, and especially for a magazine 20 having a variety of types of floor plates, such as extended floor plates or the magazine having an extended ammunition capacity.

Figure 5:
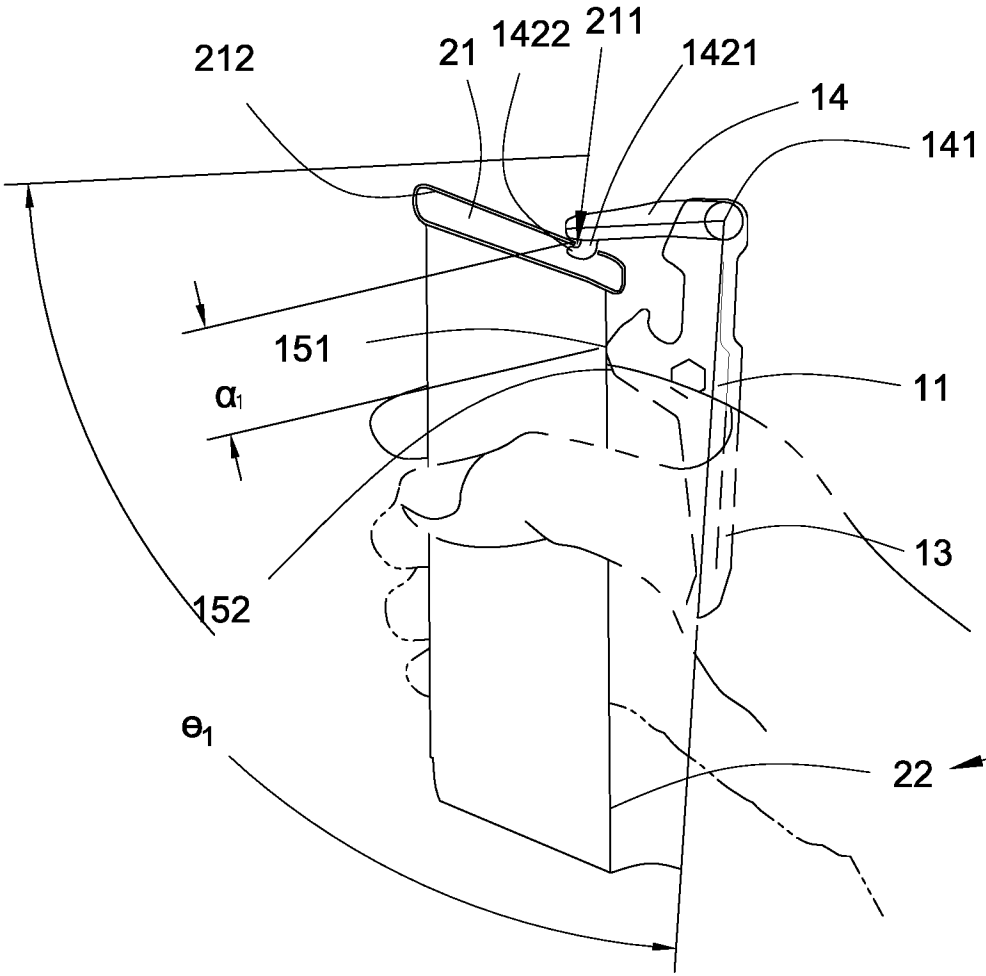
FIG. 5 is a side view of the magazine opener according to the above mentioned preferred embodiment of the present invention, illustrating that the magazine opener is cooperated with the firearm magazine.
Figure 6:
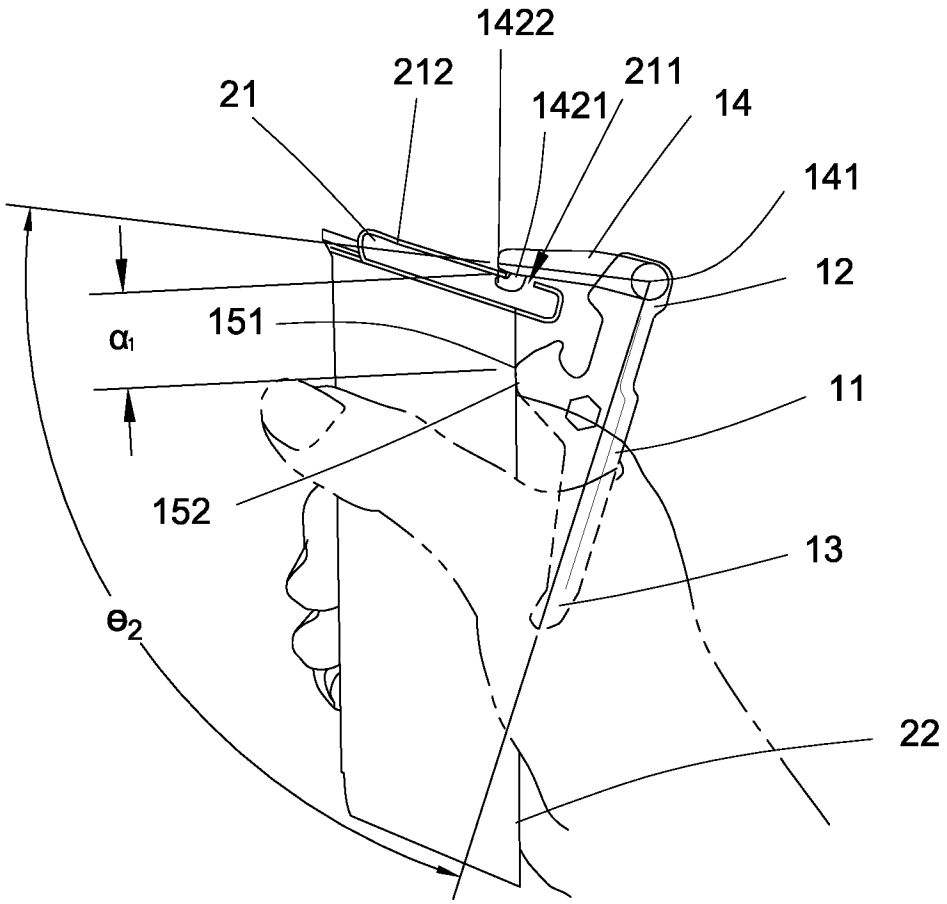
FIG. 6 is a side view of the magazine opener according to the above mentioned preferred embodiment of the present invention, illustrating that the floor plate of the firearm magazine is removed by the magazine opener.

Referring to FIG. 5 and FIG. 6 of the drawings, the magazine opener 20 is adapted to remove the floor plate 21 of the magazine 20 which is received or gripped by the magazine opener 10. As shown in FIG. 5, the L-shaped member 142 is inserted into the hole 211 of the floor plate 21, and at the same time, the engagement point 151 of the second arm 15 is biased against the side wall 221 of the magazine 20, and then a press force (F) is applied on the handle 11 to slide the floor plate 21 towards the engagement point 151 of the second arm 15. After that, the engagement surface 152 of the second arm 15 naturally touches on the side wall 221 of the magazine 20. It is worth mentioning that the L-shaped member 142 is inserted into the hole 211 of the floor plate 21 while the transversal pin 1422 is biased against with an inner surface 212 of the floor plate 21, and in other words, the floor plate 21 is hooked by the L-shaped element 142 to secure L-shaped element 142 to the floor plate 21, so while the floor plate 21 is pulled by the first arm 14 by the press force applying on the handle, the L-shaped element 142 will not detach from the floor plate 21.

It is worth mentioning that the engagement surface 152 is provided to prevent the side wall 221 of the magazine 20 being damaged during the press force F applying on directly thereon through the engagement point 152. Therefore, while the engagement surface 152 touches on the side wall 221 of the magazine 20, the contact area between second arm 15 and the side wall 221 is increased, so the press force F exerted on the second end 13 of the handle 11 can be evenly distributed on the magazine 20 without damaging the surface of the side wall 221.

Accordingly, the magazine opener 10 is adapted to remove the floor plate 21 of the magazine 20 through three points, which is a force point A formed where the press force F towards a direction is exerted thereon, the engagement point 151, and a pulling point B where the hole 211 located on floor plate 21, wherein the three points are operated through a leverage. The engagement point 151 is defined as a fulcrum, and the press force F is defined as an input force to provide a greater output pulling force P to the pulling point B for pulling the floor plate 21 towards an opposite direction. Therefore, the operator is able to provide one relatively smaller press force F on the force point A of the handle 11, and then a greater pulling force P is generated to remove the floor plate 21 from the magazine 20.

Accordingly, a longitudinal axis of the handle 11 and the first arm 14 are located to form a first angle $\theta_1$ while the L-shaped element 142 is inserted into the hole 211 of the floor plate 21. In other words, a value of the first angle $\theta_1$ naturally changes by a curvature of the side wall 221 and the shapes and sizes of the floor plate 21. For instance, the first angle $\theta_1$ generated between an extended floor plate and a regular magazine is smaller than the first angle $\theta_1$ generated between a regular floor plate and a regular magazine. After the press force F is exerted on the force point, a second angle $\theta_2$ is generated between the longitudinal axis of the handle 11 and the first arm 14. Since the first arm 14 is pivotally connected with the first end 12 of the handle 11, a value of the second angle $\theta_2$ is larger than that of the first angle $\theta_1$.

It is worth mentioning that a first distance $\alpha_1$ is formed between the L-shaped element 142 and the engagement point 151 while the L-shaped element 142 is inserted into the hole 211 of the floor plate 21, and the second arm 15 is biased against the side wall 221 of the magazine 20. After the press force F is exerted on the force point A of the handle 11, the engagement point 151 is moved upwardly towards the floor plate 21, and then the floor plate 21 is removed from the magazine 20, and in such manner, a distance between the L-shaped element 142 and the engagement point 151 is defined as a second distance $\alpha_2$, which is smaller than a value of the distance $\alpha 1$.

The magazine opener 10 is a one-hand operation tool. Therefore, the operator uses one hand holding the magazine body 22 and the handle 11 of the magazine opener 10, and then applies one press force F on the second end 13 of the handle 11 to perform the leverage between the magazine opener 10 and the magazine 20, so the floor plate 21 can be easily removed from the magazine body 22 by the small amount of press force F. In addition, the transversal pin 1422 of the L-shaped element 142 is able to secure against the detachment between the floor plate 21 and the first arm 14, so as to prevent the L-shaped element 142 being accidently detaching from the floor plate 21 during the removing of the floor plate 21.

The present invention further provides a method of removing the floor plate 21 from the magazine body 22, wherein the method comprises the following step:

(1) Insert a L-shaped element 142 into the hole 211 of the floor plate 21.

(2) Bias the engagement point 151 of the second arm 15 against the side wall 221 of the magazine body 22.

(3) Exert the press force F on the second 13 of handle 11 to remove the floor plate 21 from the magazine body 22 through the leverage.

According to the preferred embodiment, in the step (1), the transversal pin 1422 of the L-shaped element 142 is biased against the inner surface 212 of the floor plate 21, so the floor plate 21 is hooked by the L-shaped element 142, so while the pulling force P is generated to the first arm 14, the L-shaped element 142 is secured to the floor plate 21 without accidently detaching from the floor plate 21, and then the floor plate 21 is naturally pulled by the pulling force and to be removed from the magazine body 22.

According to the preferred embodiment, after the step (3), the method further comprises a step of being touching the engagement surface 152 with the side wall 221 of the magazine body 22. Accordingly, the engagement point 151 is moved upwardly along the contour of the magazine body 22, and simultaneously, the engagement surface 152 touches with the side wall 221 of the magazine body 22, so as to prevent the damage generated on the side wall 211.

It is worth mentioning that first arm 14 is pivotally connected with the first end 12 of the handle 11, and the second free end 13 of the handle 11 is provided to endure the press force F. In addition, the engagement point 151 formed on the second arm 15 is defined as the fulcrum for the leverage between the magazine opener 10 and the magazine 20. Therefore, the press force F applied on the second end 13 of the handle 11 is defined towards a direction, and the first arm naturally generates the pulling force P towards an opposite direction for removing the floor plate 21.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A magazine opener for removing a floor plate of a firearm magazine, a handle having a first end, a second end, and a first arm receiving cavity extended from said first end of said handle, wherein said handle further comprises a blocking wall formed at a bottom side of said first arm receiving cavity;

a first arm having a pivot end pivotally connected to said first end of said handle in an end-to-end manner, wherein said first arm is pivotally moved between an extended position and a stored position, wherein at said extended position, said first arm is pivotally moved out of said first arm receiving cavity of said handle until said first arm is blocked by said blocking wall, wherein at said stored position, said first arm is pivotally folded at said first end of said handle and is concealed in said first arm receiving cavity;

a second arm integrally extended from said handle, wherein a terminus of said first arm is arranged for engaging with the floor plate while said second arm is arranged for biasing against a sidewall of the magazine body as a fulcrum, such that a press force is exerted on said second end of said handle to generate a pulling force to said first arm for removing said floor plate, wherein said first arm further has a L-shaped element formed at said terminus of said first arm opposed to said pivot end thereof, wherein said L-shaped element comprises a vertical member downwardly extended from a bottom surface of said first arm and a transversal pin integrally extended from said vertical member towards a direction opposite to said first arm, wherein said transversal pin is arranged for inserting into a hole of the floor plate.

2. The magazine opener, as recited in claim 1, wherein a distance between said terminus of said first arm and said engagement point of said second arm is adjustable via a pivotal connection between said pivot end of said first arm and said first end of said handle.

3. The magazine opener, as recited in claim 2, wherein said distance between said L-shaped element and said engagement point is gradually decreased during said floor plate is removing from said magazine body.

4. The magazine opener, as recited in claim 2, wherein said second arm has an elongated configuration that a length of said first arm is longer than that said second arm, wherein when said bottom surface of said first arm is blocked by said blocking wall, said terminus of said first arm is positioned below said second arm.

5. The magazine opener, as recited in claim 2, wherein a magnitude of an angle formed between a longitudinal axis of said handle and said first arm is gradually decreased during the floor plate is removing from the magazine body.

6. The magazine opener, as recited in claim 5, wherein said engagement surface of said second arm touches with the sidewall of the magazine body while said engagement point of said second arm is moved upwardly towards the floor plate.

7. The magazine opener, as recited in claim 2, wherein said engagement surface of said second arm touches with the sidewall of the magazine body while said engagement point of said second arm is moved upwardly towards the floor plate.

8. The magazine opener, as recited in claim 1, wherein said first arm receiving cavity is extended from said first end of said handle and formed at a top portion thereof, wherein at said extended position, said first arm is pivotally moved out of said first arm receiving cavity from said top portion of said handle until said bottom surface of said first arm is blocked by said blocking wall, wherein at said stored position, said first arm is pivotally folded on said top portion of said handle to face said bottom surface of said first arm upward.

9. The magazine opener, as recited in claim 8, wherein said second arm has an engagement surface defined at a free end of said second arm, and an engaging point defined on said engagement surface for biasing against the sidewall of the magazine body.

10. The magazine opener, as recited in claim 9, wherein a distance between said terminus of said first arm and said engagement point of said second arm is adjustable via a pivotal connection between said pivot end of said first arm and said first end of said handle.

11. The magazine opener, as recited in claim 9, wherein said second arm has an elongated configuration that a length of said first arm is longer than that said second arm, wherein when said bottom surface of said first arm is blocked by said blocking wall, said terminus of said first arm is positioned below said second arm.

12. The magazine opener, as recited in claim 1, wherein said handle further has a polygonal hole formed at said handle between said first and second ends, wherein said second arm is integrally extended from said handle at a position where said polygonal hole is formed on said handle.

13. The magazine opener, as recited in claim 1, wherein said second arm has an engagement surface defined at a free end of said second arm, and an engaging point defined on said engagement surface for biasing against the sidewall of the magazine body.

14. The magazine opener, as recited in claim 1, wherein said distance between said L-shaped element and said engagement point is gradually decreased during said floor plate is removing from said magazine body.

15. The magazine opener, as recited in claim 1, wherein a magnitude of an angle formed between a longitudinal axis of said handle and said first arm is gradually decreased during the floor plate is removing from the magazine body.

* * * * *